United States Patent [19]

Pajak

[11] Patent Number: 4,561,455

[45] Date of Patent: Dec. 31, 1985

[54] PIVOTED HANDLE HAIR CURLER HAVING SELF-ADJUSTING CLAMP

[75] Inventor: Witold Pajak, Wayne, N.J.

[73] Assignee: Conair Corporation, Edison, N.J.

[21] Appl. No.: 511,631

[22] Filed: Jul. 7, 1983

[51] Int. Cl.[4] ..... A45D 2/24

[52] U.S. Cl. ..... 132/37 R; 132/32 A

[58] Field of Search ..... 132/37 R, 32 A; 219/225

[56] References Cited

U.S. PATENT DOCUMENTS

| | | | |
|---|---|---|---|
| 53,413 | 3/1866 | Christian | 132/32 A |
| 1,380,064 | 5/1921 | Hoffman | 132/32 A |
| 1,725,229 | 8/1929 | Tronc | 132/37 R |
| 4,145,600 | 3/1979 | Walter | 132/37 R |

*Primary Examiner*—Gregory E. McNeill

*Attorney, Agent, or Firm*—Haynes N. Johnson

[57] ABSTRACT

A hair curler is provided formed of a pair of handles pivoted together at one end with one handle having a heated barrel and the other handle having a hair clamp at their opposite ends. The hair clamp has a flexible spring connecting it to its handle. This permits the clamp to vary the angle of its closed position relative to the barrel and so to accommodate differing amounts and spacing of hair on the curler barrel. The handles may be spring pressed from each other at their pivot and include a complementary latching means to hold them in the closed position while hair is being set or when the unit is stored.

8 Claims, 5 Drawing Figures

PIVOTED HANDLE HAIR CURLER HAVING SELF-ADJUSTING CLAMP

BACKGROUND OF THE INVENTION

Various clamp-type hair curlers exist.

One type has a unitary handle with an extending heated barrel and a clamp pivotally connected to the handle for securing and releasing hair about the clamp. Another type, exemplified by Talbot Pat. No. 1,449,632 and Campbell Pat. No. 381,983, has a two-part handle where the two parts of the handle are pivoted at the opposite end from the heated barrel and hair clamp; and the barrel is secured to one handle and the clamp to the other. The hair curler of my invention is generally of this latter type.

Neither of these curlers permit adjustment of the angle of the clamp relative to its handle section so as to allow the barrel and clamp, when closed, to adjust relative to the amount and spacing of hair about the barrel. This lack of adjustment may result in hair being pressed between the clamp and the barrel more firmly at one end of the barrel than the other. It could even prevent hair from being firmly clamped at the outer end when there is a bulk of hair about the inner end of the barrel.

SUMMARY OF THE INVENTION

In the present invention a hair curler is provided having a pair of complementary handles that are pivotally connected at one end. The handles have a heated barrel at the outer end of one handle and a hair clamp complementary to the barrel at the outer end of the other, the barrel and clamp meeting when the handles are brought to the closed position. My curler, however, also includes a flexible spring connecting the clamp and the handle which holds the clamp. (The clamp is held in a generally axial alignment with the handle but, preferably, tends slightly inwardly toward the outer end.) The spring is stiff enough to hold the clamp and handle as a solid, inflexible unit when the curler is opened, but will flex slightly upon utilization of normal closing pressure, so that the angle of the clamp relative to the barrel can vary depending upon the amount and positioning of the hair about the barrel. Thus, relatively uniform pressure is achieved over the length of the barrel when the curler is in a closed position irrespective of the amount and location of hair on the barrel.

For convenience, the pivot inner-connecting the two handle portions includes a spring forcing the handles apart and there is a latch to interengage the two handle portions and hold them in the clamped position while hair is setting, or when the curler is stored.

DETAILED DESCRIPTION OF THE INVENTION

Figure 1:
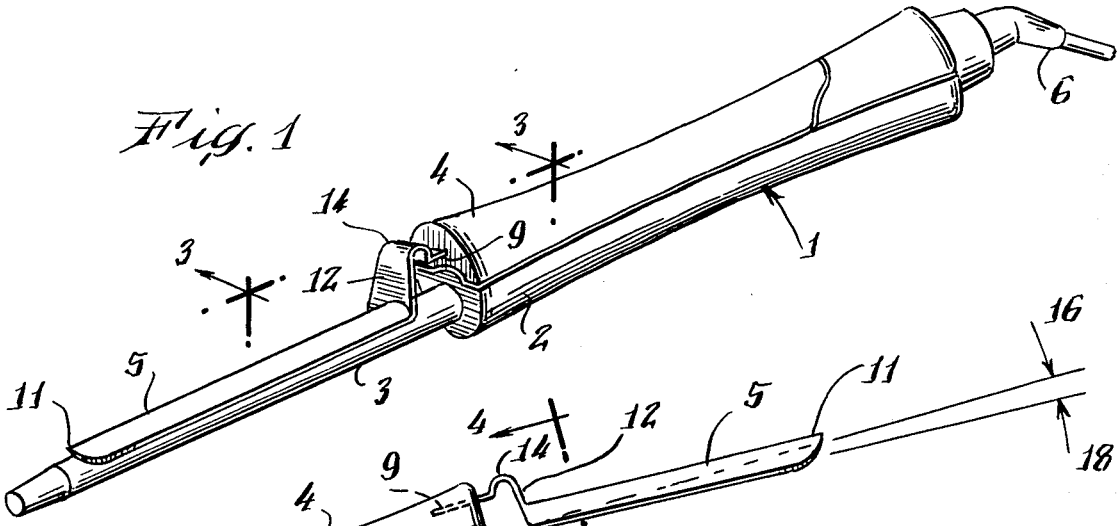
FIG. 1 is a perspective view of the hair curler of my invention, shown in its closed position.

The curler 1 of this invention is generally shown in FIG. 1. The heated barrel 3 and the complementary hair holding clamp 5 are at the left of the figure. The handle and the electric cord 6 (preferably in a swivel mount) are on the right. The handle is formed of two complementary sections 2 and 4, pivotally connected at their right hand outer end near the electric cord inlet 6 (see spring pivot 10 in FIGS. 2 and 5). The lower handle 2 is secured in axial alignment with heated barrel 3; and hair clamp 5 extends from the left end of the upper handle 4.

Figure 4:
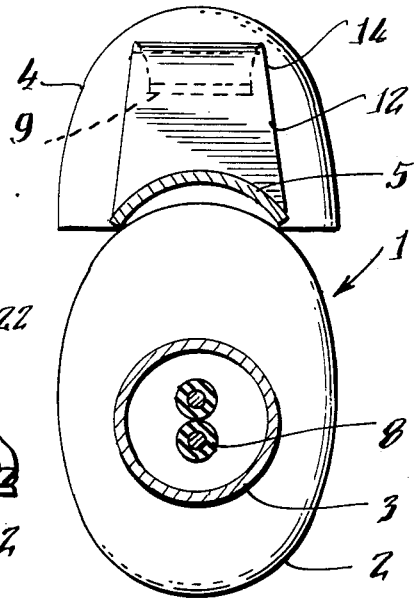
FIG. 4 is a section on line 4—4 of FIG. 2 showing the relative positions of the hair clamp and barrel when the curler is open.

Electrical heater leads 8 entering barrel 3 are shown in FIG. 4. These are connected to electric cord 6 through switch 7. The heater within barrel 3 may be a rope heater or any other conventional type.

Figure 2:
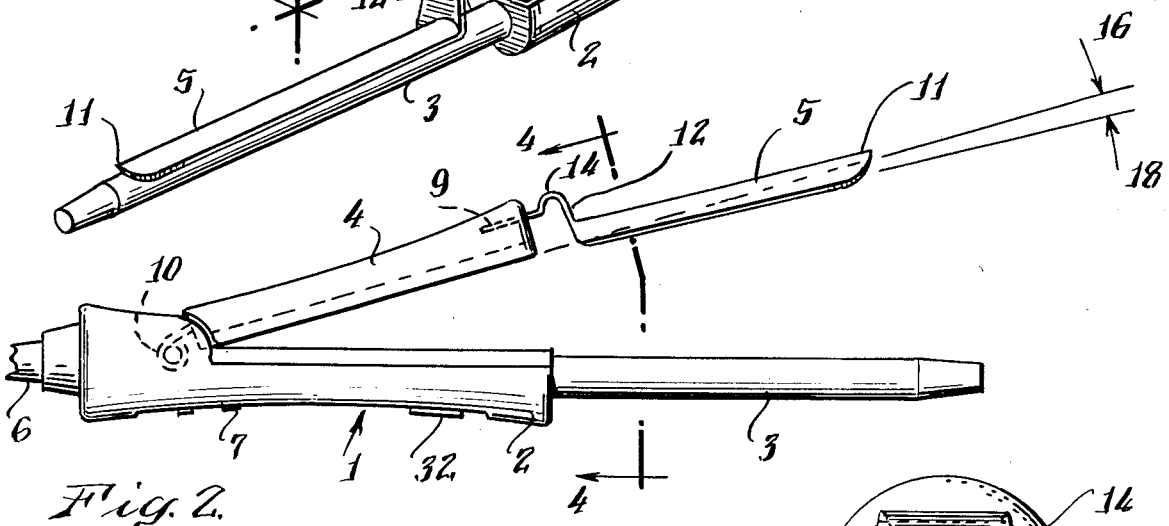
FIG. 2 is a side elevational view of the curler in its open position, showing the spring interconnection between the handle and the hair clamp and the slight angular tilt of the clamp relative to the axis of its handle.
Figure 5:
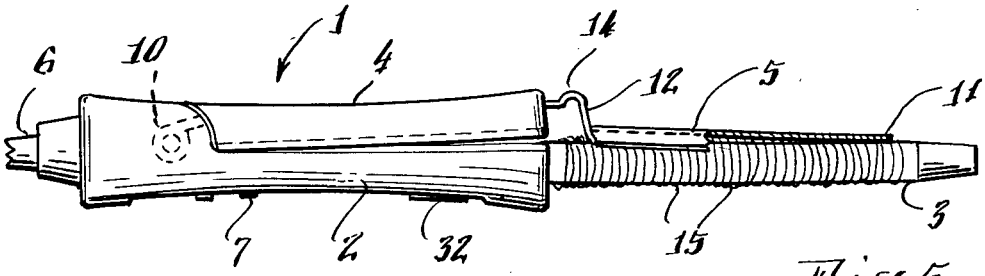
FIG. 5 is a side view of the curler, partially broken away, in an almost closed position. It shows how the spring associated with the hair clamp serves to adjust the angle of the clamp to provide uniform pressure upon hair wrapped around the heated barrel of the curler.

The curler 1 is shown in its open position in FIG. 2, held open by the spring-pressed pivot 10; and FIG. 5 shows the curler in an almost closed position. It should be noted that, in FIG. 5, handles 2 and 4 are not quite in closed contact.

As can be seen in each of the figures, hair clamp 5 is not directly connected to handle 4. Rather, the metal which forms clamp 5 has been bent into a spring-shaped interconnection 12. As can be seen, spring 12 is formed of the same metallic piece as clamp 5 and has a U-shaped bend 14 in the area between handle 4 and clamp 5, proximate to handle 4. This U-shaped portion provides a spring connection that is stiff enough to hold clamp 5 in a fixed position relative to handle 4 when the curler is in its open position, but which will flex slightly around the hair and barrel 3 when it is closed. Consequently, the angle of clamp 5 relative to the handle 4 is self adjusting under closing pressure against barrel 3 and the strands of hair 15 about barrel 3 (FIG. 5.) This allows closing pressure between handles 2 and 4 to provide a generally uniform pressure between barrel 3 and clamp 5.

It has been found that the self adjusting feature of the curler works best if hair clamp 5 is at a slight angle to barrel 3 when it first contacts the barrel. That is, outer end 11 of clamp 5 should make contact with the outer end of barrel 3 first, before the entire clamp 5 makes contact with the relative angles such that outer end 11 of clamp 5 touches the outer end of barrel 3 first and just before handles 2 and 4 are completely closed, as shown in FIG. 5. The preferred way of accomplishing this is to have handle 2 and barrel 3 in axial alignment, and to have clamp 5 slightly out of axial alignment with handle 4, as shown in FIG. 2. Projection lines 16 and 18 in FIG. 2 show the axis of handle 4 and clamp 5, respectively; and, as can be seen, clamp 5 tilts slightly downward at its outer end with respect to handle 4 by a few degrees.

The result is, that in using the hair curler, one can wrap strands of hair 15 around barrel 3 and, as the curler is closed, the angular position of clamp 5 is varied through flexing of spring 12. The degree of variation of angle upon closure depends upon the quantity and position of hair 15 about barrel 13. As a result of this flexing, more uniform pressure is applied to the hair throughout the length of barrel 13 when the curler is in its closed position. Otherwise phrased, one avoids the possibility of having a thick tress of hair, about one part of barrel 3, cause a lack of contact with clamp 5 throughout the entire length of the barrel. To this end, of course, the unit is designed such that when fully closed as shown in FIG. 1, clamp 5 is in contact with barrel 3 throughout its length.

Figure 3:
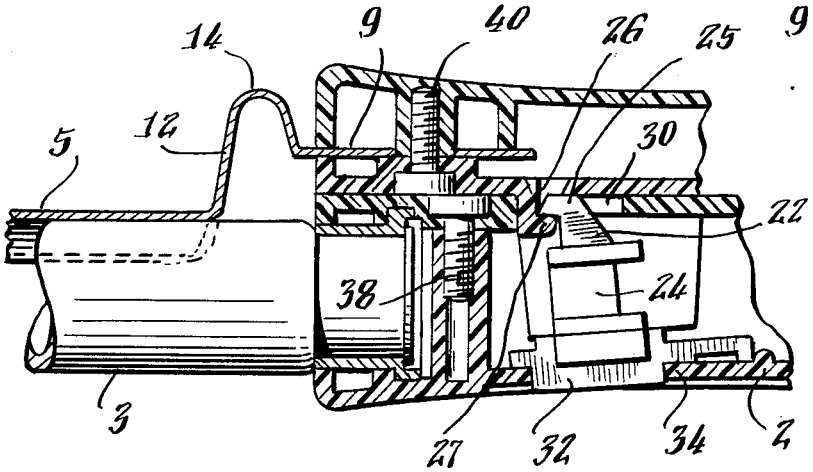
FIG. 3 is a section on line 3—3 of FIG. 1 disclosing details of the latch mechanism.

It is helpful to have a means for latching handles 2 and 4 in their closed position, not only for storage, but also to hold them together while hair is being curled. FIG. 3 discloses a latch structure, generally depicted by the numeral 22. This latch includes sliding latch 24 within handle 2, having a latching hook 25, and fixed latch 26, with latching hook 27, in handle 4. As shown in FIG. 3 hook 25 and 27 are interengaged, holding handles 2 and 4 in their closed position.

Sliding latch 24 is mounted for generally axial sliding movement within handle 2 and has hook 25 sliding in slot 30 in the upper surface of handle 2 and integrally molded actuating button 32 sliding in slot 34 in the lower surface of handle 2. Accordingly, by sliding button 32 within slot 34 while handles 2 and 4 are held together, handles 2 and 4 will be held in a locked position by the interengagement of hooks 25 and 27 or released by the disengagement of the two hooks.

FIG. 3 also shows a portion of the construction used to hold the unit together. Bolt 38 holds together the sections of handle 2 and also holds barrel 3 in place in the handle. Bolt 40 in handle 4 secures the inner end 9 of clamp 5 within handle 4.

I claim:

1. In a hair curler of the type having a pair of handles pivotally connected at one end, a barrel at the outer end of one said handle and a complementary hair clamp at the outer end of the other said handle, with said barrel and said clamp engaging when said handles are pivoted to their closed position, the improvement including a spring interposed between and interconnecting said clamp and its respective said handle, said spring having sufficient stiffness to hold said clamp and its respective said handle in the same relative alignment while said curler is open and having sufficient flexibility to adapt its angle when said curler is closed over hair on said barrel to permit a substantially complementary fit of said clamp about said hair and said barrel, said adaptation being dependent upon the amount and positioning of hair on said barrel, whereby relatively uniform pressure is applied by said clamp to said hair over the length of said barrel.

2. A hair curler as set forth in claim 1 in which said spring is of U-shaped configuration and is integral with said hair clamp.

3. A hair curler as set forth in claim 1 in which said spring holds said clamp at an angle to its respective said handle, said angle inclining towards said barrel when said curler is in its open position.

4. A hair curler as set forth in claim 1 in which said pivot interconnecting said handles is spring pressed to hold said handles to an open position and including latch means in said handles positioned to interengage and hold said handles in a closed position.

5. A hair curler as set forth in claim 4 in which said latch means is a sliding latch with complementary engaging hooks, one of said hooks being in each of said handles.

6. A hair curler adapted to apply substantially uniform pressure to hair wrapped about a heated barrel and held by a hair clamp, including a pair of complementary handles, a barrel carried at the end of one said handle and a hair clamp complementary to said barrel carried at the corresponding end of the other said handle, said handles being pivotally interconnected at the opposite ends thereof, said handles being spring pressed to an open position, said clamp being deformed proximate to its said respective handle to form a spring permitting relative angular movement between said clamp and its respective said handle, said spring being of sufficient stiffness to hold said clamp and its respective said handle in the same relative positions when said curler is open and having sufficient flexibility to change its angle relative to its respective handle when said curler is closed about said barrel as to vary it according to the quantity and positioning of hair about said barrel, whereby relatively uniform pressure is applied by said clamp to said hair over the length of said barrel while said hair is being curled.

7. A hair curler as set forth in claim 6 in which said spring is of U-shaped configuration.

8. A hair curler as set forth in claim 6 in which said spring holds said clamp at an angle to the said handle holding said clamp which angle inclines towards said barrel when said curler is in its open position.

* * * * *